US008531357B2

(12) United States Patent
Murata et al.

(10) Patent No.: US 8,531,357 B2
(45) **Date of Patent: *Sep. 10, 2013**

(54) METHOD OF DRIVING A PLASMA DISPLAY PANEL TO COMPENSATE FOR THE INCREASE IN THE DISCHARGE DELAY TIME AS THE NUMBER OF SUSTAIN PULSES INCREASES

(75) Inventors: Mitsuhiro Murata, Hyogo (JP); Yusuke Fukui, Osaka (JP); Toshikazu Wakabayashi, Osaka (JP); Hiroshi Asano, Osaka (JP)

(73) Assignee: Panasonic Corporation, Osaka (JP)

( * ) Notice: Subject to any disclaimer, the term of this patent is extended or adjusted under 35 U.S.C. 154(b) by 358 days.

This patent is subject to a terminal disclaimer.

(21) Appl. No.: 12/596,757

(22) PCT Filed: Apr. 14, 2009

(86) PCT No.: PCT/JP2009/001717

§ 371 (c)(1), (2), (4) Date: Oct. 20, 2009

(87) PCT Pub. No.: WO2009/128255

PCT Pub. Date: Oct. 22, 2009

(65) Prior Publication Data

US 2010/0134453 A1 Jun. 3, 2010

(30) Foreign Application Priority Data

Apr. 15, 2008 (JP) ..... 2008-105420

(51) Int. Cl.
*G09G 3/28* (2013.01)
*H01J 17/49* (2012.01)

(52) U.S. Cl.
USPC ..... 345/71; 313/587

(58) Field of Classification Search
USPC ..... 345/60–72; 315/169.4; 313/581–587
See application file for complete search history.

(56) References Cited

U.S. PATENT DOCUMENTS 5,757,343 A * 5/1998 Nagakubo ..... 345/63
6,097,358 A 8/2000 Hirakawa et al.

(Continued)

FOREIGN PATENT DOCUMENTS

EP 2 031 629 3/2009
EP 2 031 630 3/2009

(Continued)

OTHER PUBLICATIONS

International Search Report issued May 26, 2009 in International (PCT) Application No. PCT/JP2009/001717.

*Primary Examiner* — Chanh Nguyen
*Assistant Examiner* — Navin Lingaraju
(74) *Attorney, Agent, or Firm* — Wenderoth, Lind & Ponack, L.L.P.

(57) ABSTRACT

Protective layer (26) of front plate (20) of a plasma display panel has base protective layer (26*a*) and particle layer (26*b*). Base protective layer (26*a*) is formed of a thin film of metal oxide containing at least one of magnesium oxide, strontium oxide, calcium oxide, and barium oxide. Particle layer (26*b*) is formed by sticking, to base protective layer (26*a*), single crystal particles (27) of magnesium oxide having an NaCl crystal structure that is surrounded by a specified two-type orientation face formed of (100) face and (111) face or a specified three-type orientation face formed of (100) face, (110) face, and (111) face. The panel driving circuit drives the panel while temporally disposing the subfields so that the luminance weight monotonically decreases from a subfield in which an all-cell initializing operation is performed to the subfield immediately before the subfield in which its next all-cell initializing operation is performed.

2 Claims, 13 Drawing Sheets

(56) References Cited

U.S. PATENT DOCUMENTS

| | | | | |
|---|---|---|---|---|
| 6,236,380 | B1 * | 5/2001 | Wani et al. | 345/60 |
| 6,294,875 | B1 * | 9/2001 | Kurata et al. | 315/169.1 |
| 6,404,411 | B1 * | 6/2002 | Masuda et al. | 345/66 |
| 6,501,446 | B1 * | 12/2002 | De Haan et al. | 345/63 |
| 8,089,211 | B2 | 1/2012 | Fukui et al. | |
| 8,183,775 | B2 | 5/2012 | Fukui et al. | |
| 2001/0020923 | A1 * | 9/2001 | Homma | 345/60 |
| 2003/0218581 | A1 * | 11/2003 | Kawanami et al. | 345/60 |
| 2006/0114186 | A1 * | 6/2006 | Lee et al. | 345/67 |
| 2008/0157673 | A1 * | 7/2008 | Fukui et al. | 313/587 |
| 2010/0109984 | A1 * | 5/2010 | Murata et al. | 345/60 |

FOREIGN PATENT DOCUMENTS

| | | |
|---|---|---|
| JP | 11-95718 | 4/1999 |
| JP | 2000-105568 | 4/2000 |
| JP | 2006-54158 | 2/2006 |
| JP | 2006-098751 | 4/2006 |
| JP | 2006-98751 | 4/2006 |
| JP | 2006-251337 | 9/2006 |
| WO | 2007/139184 | 12/2007 |

* cited by examiner

METHOD OF DRIVING A PLASMA DISPLAY PANEL TO COMPENSATE FOR THE INCREASE IN THE DISCHARGE DELAY TIME AS THE NUMBER OF SUSTAIN PULSES INCREASES

TECHNICAL FIELD

The present invention relates to a plasma display device as an image display device using a plasma display panel.

BACKGROUND ART

A plasma display panel (hereinafter referred to as "panel"), among thin image display elements, allows high speed display and can be easily enlarged, so that the panel becomes commercially practical as a large-screen display device.

The panel is formed by sticking a front plate to a back plate. The front plate has the following elements:

- a glass substrate;
- display electrode pairs that are disposed on the glass substrate and each of which is formed of a scan electrode and a sustain electrode;
- a dielectric layer formed so as to cover the display electrode pairs; and
- a protective layer formed on the dielectric layer.

The protective layer protects the dielectric layer from ion collision and facilitates discharge.

The back plate has the following elements:

- a glass substrate;
- data electrodes formed on the glass substrate;
- a dielectric layer for covering the data electrodes;
- barrier ribs formed on the dielectric layer; and
- phosphor layers that are disposed between the barrier ribs and emit red, green, and blue lights, respectively.

The front plate and back plate are faced to each other so that the display electrode pairs intersect with the data electrodes while discharge space is sandwiched, and their periphery is sealed with low-melting glass. Discharge gas containing xenon is filled into the discharge space. Discharge cells are formed in the parts where the display electrode pairs face the data electrodes.

In a plasma display device using the panel having this structure, a gas discharge is selectively caused in respective discharge cells of the panel, ultraviolet rays generated at this time excite red, green, and blue phosphors to emit lights, and thus color display is attained.

A subfield method is generally used as a method of driving the panel. In this method, one field period is divided into a plurality of subfields, and the subfields in which light is emitted are combined, thereby performing gradation display. Each subfield has an initializing period, an address period, and a sustain period. In the initializing period, a predetermined voltage is applied to the scan electrodes and the sustain electrodes to cause the initializing discharge, and wall charge required for a subsequent address operation is produced on each electrode. In the address period, a scan pulse is sequentially applied to the scan electrodes, and an address pulse is selectively applied to the data electrodes to cause address discharge, thereby producing wall charge. In the sustain period, a sustain pulse is alternately applied to the display electrode pairs, a sustain discharge is selectively caused in the discharge cells, and a phosphor layer of the corresponding discharge cell is light-emitted, thereby displaying an image.

In order to display a high-quality image by controlling the panel so that light emission is secured in a discharge cell to emit light and no light emission is secured in a discharge cell to emit no light, a certain address operation is required within an assigned time. For this purpose, a panel capable of being driven at a high speed has been developed, and a driving method and driving circuit for exploiting the performance of the panel and displaying a high-quality image have been studied.

The discharge characteristic of the panel largely depends on the characteristic of the protective layer. Especially, in order to improve the electron emission performance and charge retention performance that affect the possibility of the high speed driving, the material, structure, and manufacturing method of the protective layer have been studied widely. Patent literature 1, for example, discloses a plasma display device having the following elements:

- a panel having a magnesium oxide layer that is produced by gas phase oxidation of magnesium vapor and has a cathode luminescence emission peak at a wavelength of 200 to 300 nm; and
- an electrode driving circuit for sequentially applying a scan pulse to one electrode of each of the display electrode pairs constituting all display lines in the address period and applying, to the data electrode, the address pulse corresponding to the display line to which the scan pulse is applied.

Recently, a plasma display device having a large screen and high definition has been demanded. For example, a high definition plasma display device having 1920 pixels and 1080 lines has been demanded, further an extremely high definition plasma display device having 2160 lines or 4320 lines has been demanded. While the number of lines is increased, the number of subfields for displaying the smooth gradation needs to be secured. Therefore, the time assigned to the address operation per line is apt to become increasingly shorter. In order to perform a certain address operation within the assigned time, a plasma display device is demanded that has a panel allowing stabler and higher-speed address operation than that of the conventional art, its driving method, and a driving circuit for achieving it.

[Patent Literature 1] Unexamined Japanese Patent Publication No. 2006-54158

SUMMARY OF THE INVENTION

The plasma display device of the present invention has a panel and a panel driving circuit. The panel has the following elements:

- a front plate having display electrode pairs on a first glass substrate, a dielectric layer for covering the display electrode pairs, and a protective layer on the dielectric layer;
- a back plate that faces the front plate and has data electrodes on a second glass substrate; and
- discharge cells formed at the positions where the display electrode pairs face the data electrodes.

The panel driving circuit drives the panel while a plurality of subfields are temporally disposed to form one field period. Here, each subfield has an initializing period for causing initializing discharge, an address period for causing address discharge, and a sustain period for causing sustain discharge in the discharge cells. The protective layer has a base protective layer and a particle layer. The base protective layer is formed of a thin film of metal oxide containing at least one of magnesium oxide, strontium oxide, calcium oxide, and barium oxide. The particle layer is formed by sticking single crystal particles of magnesium oxide to the base protective layer. Here, single crystal particles have an NaCl crystal structure that is surrounded by a specified two-type orientation face formed of (100) face and (111) face and a specified three-type orientation face formed of (100) face, (110) face, and (111) face. The panel driving circuit drives the panel by the following processes:

in the initializing period, performing one of an all-cell initializing operation of causing initializing discharge in all discharge cells and a selective initializing operation of causing initializing discharge in the discharge cell that has undergone a sustain discharge before it;

temporally disposing the subfields so that the luminance weight monotonically decreases from the subfield in which the all-cell initializing operation is performed to the subfield immediately before the subfield in which the next all-cell initializing operation is performed; and driving the panel.

REFERENCE MARKS IN THE DRAWINGS

Figure 1:
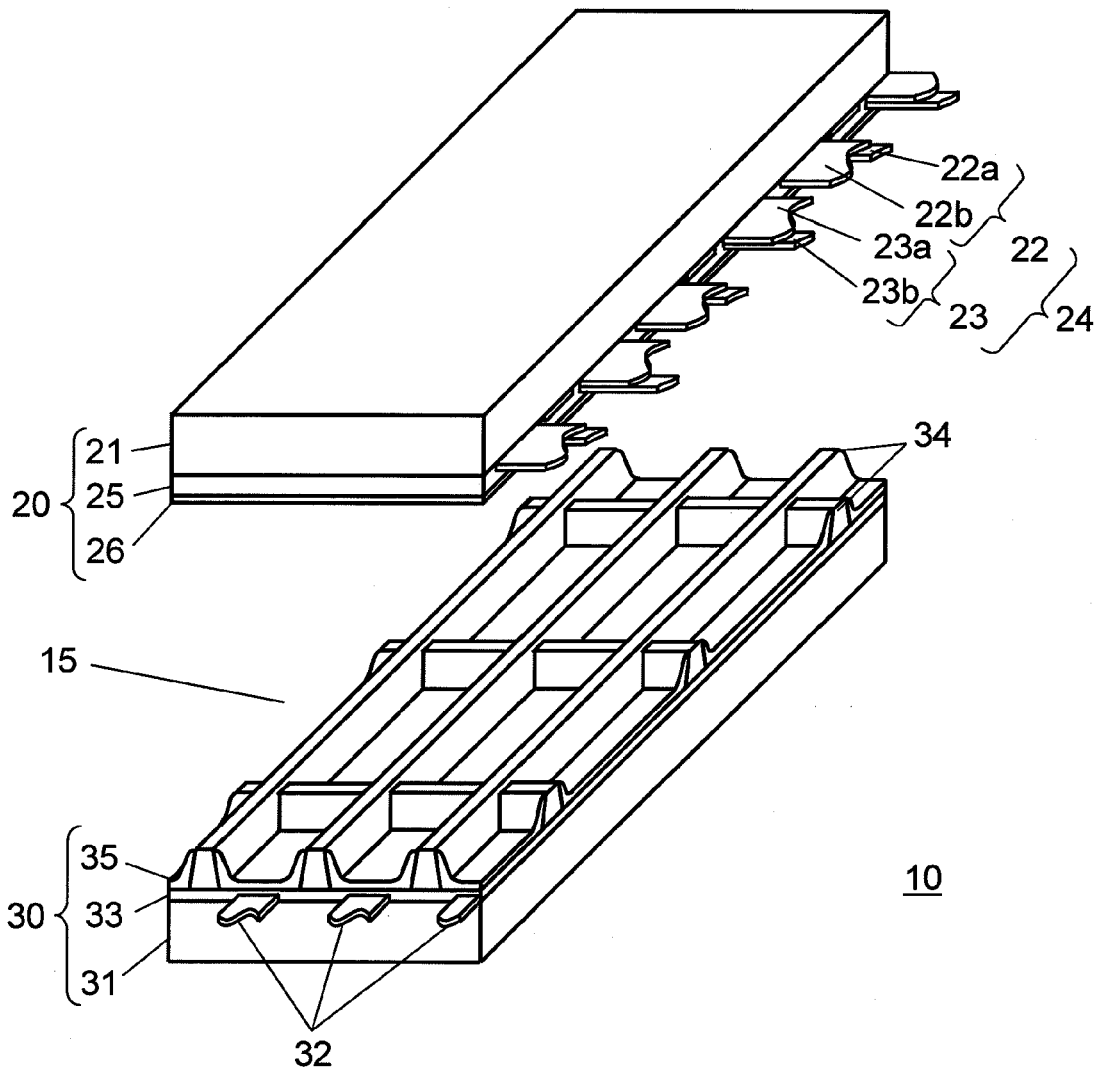
FIG. 1 is a perspective view showing a structure of a panel in accordance with an exemplary embodiment of the present invention.

10 panel
20 front plate
21 (first) glass substrate
22 scan electrode
22*a*, 23*a* transparent electrode
22*b*, 23*b* bus electrode
23 sustain electrode
24 display electrode pair
25 dielectric layer
26 protective layer
26*a* base protective layer
26*b* particle layer
27 single crystal particle
30 back plate
31 (second) glass substrate
32 data electrode
34 barrier rib
35 phosphor layer
41 image signal processing circuit
42 data electrode driving circuit
43 scan electrode driving circuit
44 sustain electrode driving circuit
45 timing generating circuit
50, 80 sustain pulse generating circuit
60 initializing waveform generating circuit
70 scan pulse generating circuit
100 plasma display device

DETAILED DESCRIPTION OF PREFERRED EMBODIMENTS

A plasma display device in accordance with an exemplary embodiment of the present invention will be described hereinafter with reference to the accompanying drawings.

Exemplary Embodiment

FIG. 1 is a perspective view showing a structure of panel 10 in accordance with an exemplary embodiment of the present invention. In panel 10, front plate 20 and back plate 30 are faced to each other, and their periphery is sealed with a sealing material made of low-melting glass. Discharge gas such as xenon is filled at a pressure of 400 to 600 Torr into discharge space 15 in panel 10.

A plurality of display electrode pairs 24 each of which is formed of scan electrode 22 and sustain electrode 23 are disposed in parallel on glass substrate (first glass substrate) 21 of front plate 20. Dielectric layer 25 is formed on glass substrate 21 so as to cover display electrode pairs 24, and protective layer 26 mainly made of magnesium oxide is formed on dielectric layer 25.

A plurality of data electrodes 32 are disposed in parallel in the direction orthogonal to display electrode pairs 24 on glass substrate (second glass substrate) 31 of back plate 30, and are covered with dielectric layer 33. Barrier ribs 34 are disposed on dielectric layer 33. Phosphor layers 35 for emitting red, green, and blue lights with ultraviolet rays are formed on dielectric layer 33 and on side surfaces of barrier ribs 34, respectively. Discharge cells are formed at the positions where display electrode pairs 24 intersect with data electrodes 32, and a set of discharge cells having phosphor layers 35 for red, green, and blue form a pixel for color display. Dielectric layer 33 is not essential, but a structure having no dielectric layer 33 may be employed.

Figure 2:
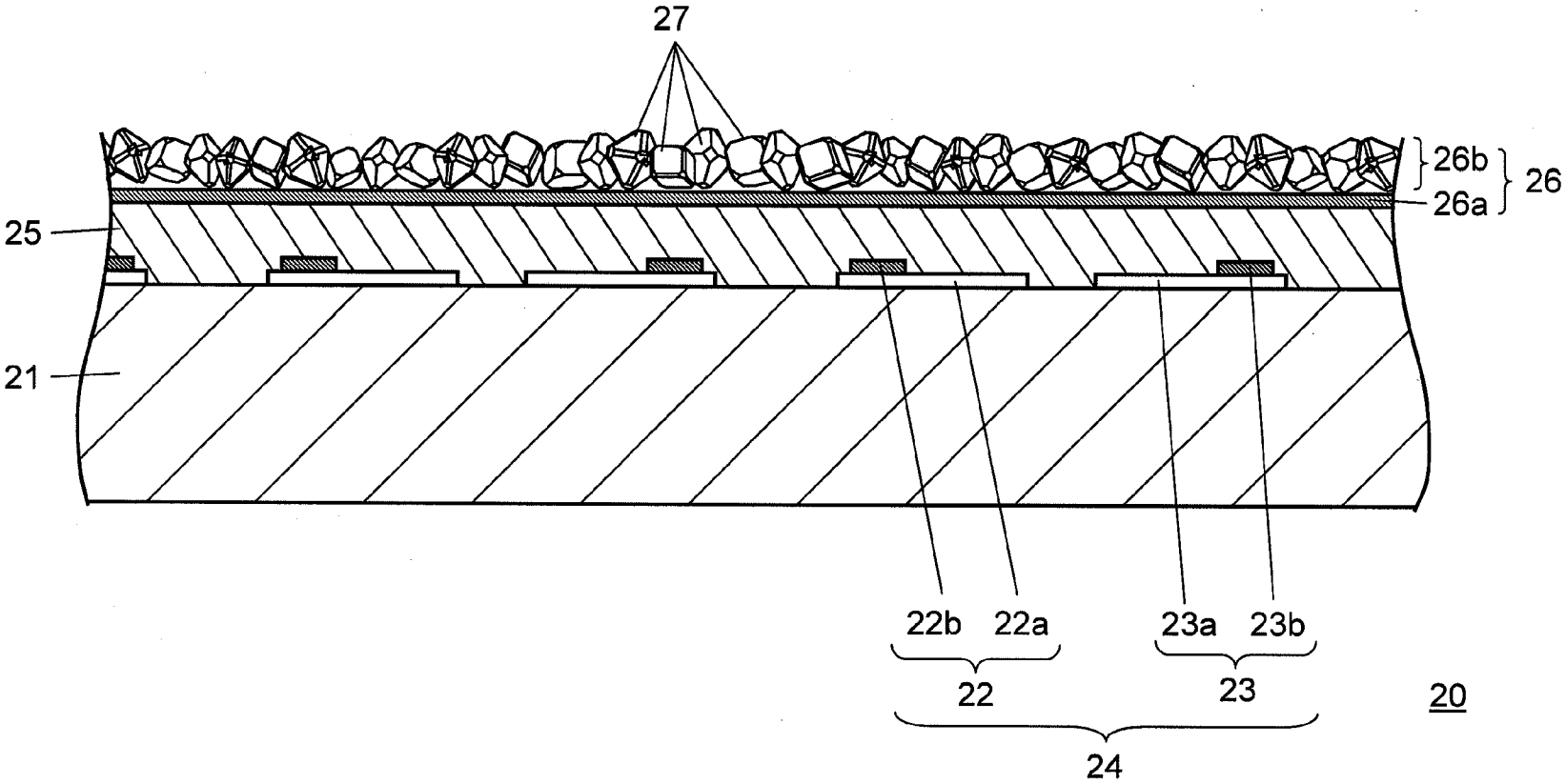
FIG. 2 is a sectional view showing a structure of a front plate of the panel.

FIG. 2 is a sectional view showing a structure of front plate 20 of panel 10 in accordance with the exemplary embodiment of the present invention, and is illustrated by turning front plate 20 of FIG. 1 upside down. Display electrode pairs 24 formed of scan electrodes 22 and sustain electrodes 23 are disposed on glass substrate 21. Each scan electrode 22 is formed of transparent electrode 22*a* made of indium tin oxide or tin oxide, and bus electrode 22*b* disposed on transparent electrode 22*a*. Similarly, sustain electrode 23 is formed of transparent electrode 23*a*, and bus electrode 23*b* disposed on it. Bus electrode 22*b* and bus electrode 23*b* are disposed for applying conductivity in the longitudinal direction of transparent electrode 22*a* and transparent electrode 23*a*, and are made of a conductive material mainly containing silver.

Dielectric layer 25 is formed by applying low-melting glass or the like mainly made of lead oxide, bismuth oxide, or phosphorous oxide by a screen printing method or a die coating method, and firing it.

Protective layer 26 is formed on dielectric layer 25. Protective layer 26 is hereinafter described in detail. Protective layer 26 protects dielectric layer 25 from ion collision and improves the electron emission performance and charge retention performance that significantly affect the driving speed. For this purpose, protective layer 26 is formed of base protective layer 26*a* disposed on dielectric layer 25 and particle layer 26*b* disposed on base protective layer 26*a*.

Base protective layer 26*a* is a thin film that is mainly made of magnesium oxide and is formed by a thin film forming method such as a vacuum deposition method or an ion plating method, and has a thickness of 0.3 to 1.0 μm, for example. Base protective layer 26*a* may be made of metal oxide containing at least one of magnesium oxide, strontium oxide, calcium oxide, and barium oxide.

Particle layer 26*b* is formed by sticking single crystal particles 27 of magnesium oxide to base protective layer 26*a* so that the particles are distributed substantially uniformly over the whole surface thereof.

Figure 3A:
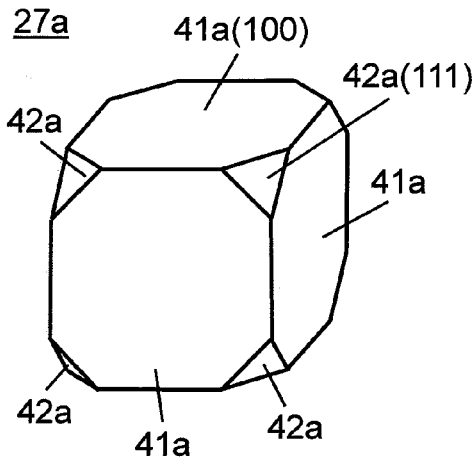
FIG. 3A is a diagram showing an example of the shapes of single crystal particles of the panel.
Figure 3B:
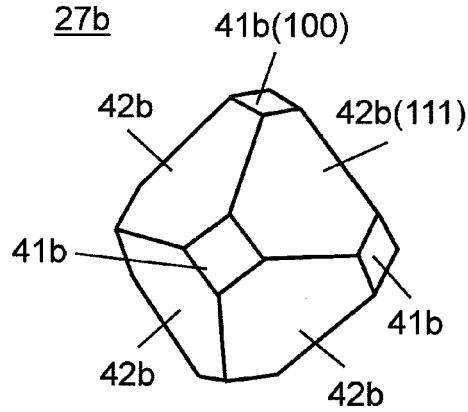
FIG. 3B is a diagram showing another example of the shapes of the single crystal particles of the panel.

FIG. 3A is a diagram showing an example of the shapes of single crystal particles 27 of panel 10 in accordance with the exemplary embodiment of the present invention. FIG. 3A shows single crystal particle 27*a* with a tetradecahedron shape having truncated faces that are formed by cutting the vertexes of a hexahedron as a basic shape. Here, main faces 41*a* are (100) faces, and truncated faces 42*a* are (111) faces. FIG. 3B is a diagram showing another example of the shapes of single crystal particles 27. FIG. 3B shows single crystal particle 27*b* with a tetradecahedron shape having truncated faces that is formed by cutting the vertexes of an octahedron as a basic shape. Here, main faces 42*b* are (111) faces, and truncated faces 41*b* are (100) faces. Thus, single crystal particle 27*a* and single crystal particle 27*b* have an NaCl crystal structure that is surrounded by the specified two-type orientation face formed of (100) faces and (111) faces.

Figure 3C:
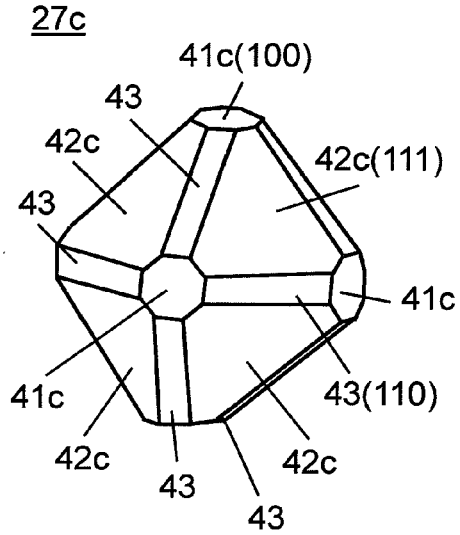
FIG. 3C is a diagram showing yet another example of the shapes of the single crystal particles of the panel.
Figure 3D:
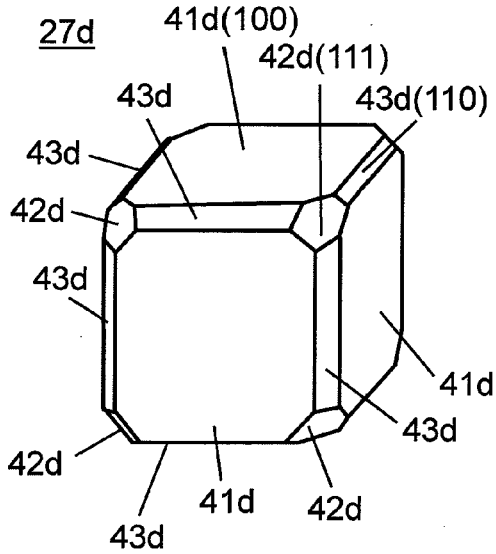
FIG. 3D is a diagram showing still another example of the shapes of the single crystal particles of the panel.

FIG. 3C is a diagram showing yet another example of the shapes of single crystal particles 27. FIG. 3C shows single crystal particle 27*c* with an icosihexahedron shape having rhombic faces that is formed by cutting the boundaries of (111) faces of the shape of single crystal particle 27*b*. Here, main faces 42*c* are (111) faces, truncated faces 41*c* are (100) faces, and rhombic faces 43*c* are (110) faces. FIG. 3D is a diagram showing still another example of the shapes of single crystal particles 27. FIG. 3D shows single crystal particle 27*d* with an icosihexahedron shape having rhombic faces that is formed by cutting the ridge lines of adjacent (100) faces of the shape of single crystal particle 27*a*. Here, main faces 41*d* are (100) faces, truncated faces 42*d* are (111) faces, and rhombic faces 43*d* are (110) faces. Thus, single crystal particle 27*c* and single crystal particle 27*d* have an NaCl crystal structure that is surrounded by the specified three-type orientation face formed of (100) faces, (110) faces, and (111) faces.

Figure 4A:
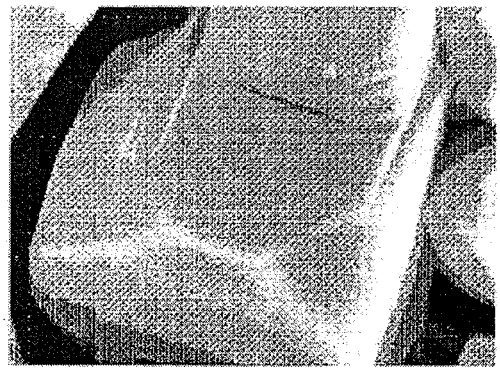
FIG. 4A is a diagram showing an electron micrograph showing a shape of single crystal particles of magnesium oxide contained in a particle layer of the panel.
Figure 4B:
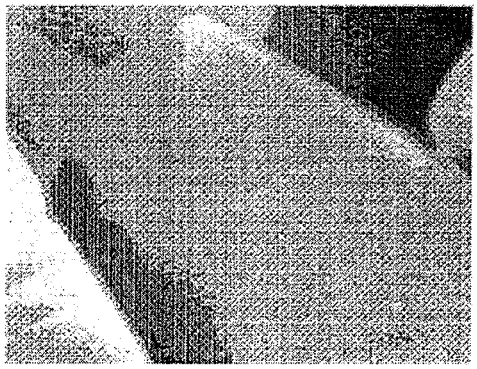
FIG. 4B is a diagram showing an electron micrograph showing another shape of the single crystal particles of magnesium oxide contained in the particle layer of the panel.
Figure 4C:
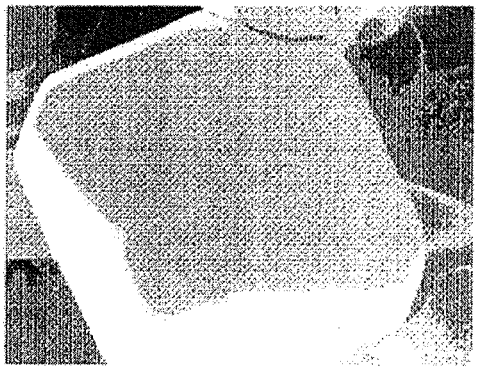
FIG. 4C is a diagram showing an electron micrograph showing yet another shape of the single crystal particles of magnesium oxide contained in the particle layer of the panel.

FIG. 4A is a diagram showing an electron micrograph showing the shape of single crystal particle 27*a* of magnesium oxide contained in particle layer 26*b* of panel 10 in accordance with the exemplary embodiment of the present invention. FIG. 4B is a diagram showing an electron micrograph showing the shape of single crystal particle 27*b* of magnesium oxide contained in particle layer 26*b*. FIG. 4C is a diagram showing an electron micrograph showing single crystal particle 27*c* of magnesium oxide contained in particle layer 26*b*. According to these diagrams, particle layer 26*b* actually contains single crystal particle 27 with a slightly deformed shape.

Figure 5A:
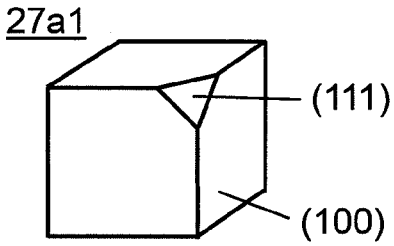
FIG. 5A is a diagram showing another shape of the single crystal particles contained in the particle layer of the panel.
Figure 5B:
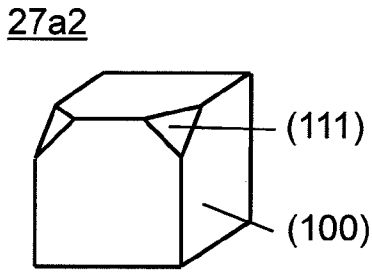
FIG. 5B is a diagram showing yet another shape of the single crystal particles contained in the particle layer of the panel.
Figure 5C:
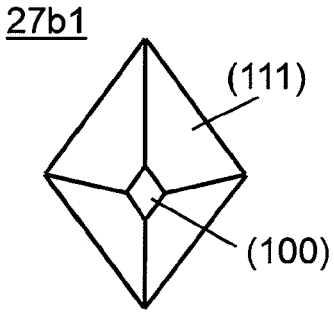
FIG. 5C is a diagram showing still another shape of the single crystal particles contained in the particle layer of the panel.
Figure 5D:
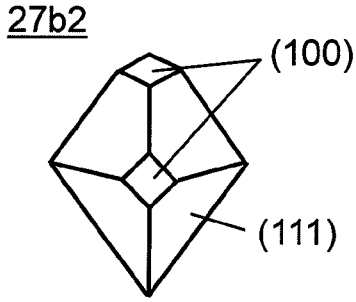
FIG. 5D is a diagram showing still another shape of the single crystal particles contained in the particle layer of the panel.
Figure 5E:
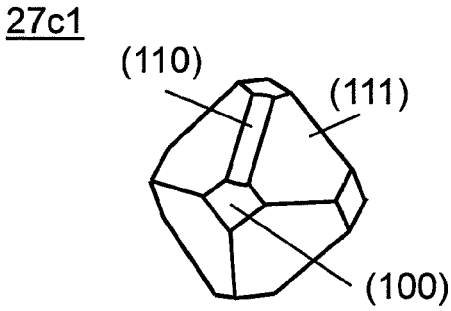
FIG. 5E is a diagram showing still another shape of the single crystal particles contained in the particle layer of the panel.
Figure 5F:
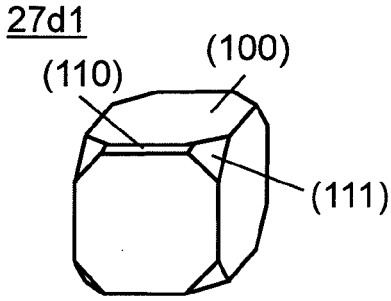
FIG. 5F is a diagram showing still another shape of the single crystal particles contained in the particle layer of the panel.

The truncated faces are not formed at all vertexes, and the rhombic faces are not formed at all ridge lines. FIG. 5A is a diagram showing another shape of single crystal particles 27 contained in particle layer 26*b* of panel 10 in accordance with the exemplary embodiment of the present invention. FIG. 5A shows a variation of single crystal particle 27*a*, and a shape having one truncated face. FIG. 5B shows a variation of single crystal particle 27*a*, and a shape having two truncated faces. FIG. 5C is a diagram showing still another shape of single crystal particles 27 contained in particle layer 26*b* of panel 10 in accordance with the exemplary embodiment of the present invention. FIG. 5C shows a variation of single crystal particle 27*b*, and a shape having one truncated face. FIG. 5D shows a variation of single crystal particle 27*b*, and a shape having two truncated faces. FIG. 5E is a diagram showing still another shape of single crystal particles 27 contained in particle layer 26*b* of panel 10 in accordance with the exemplary embodiment of the present invention. FIG. 5E shows a variation of single crystal particle 27*c*, and a shape having six truncated faces and one rhombic face. FIG. 5F is a diagram showing still another shape of single crystal particles 27 contained in particle layer 26*b* of panel 10 in accordance with the exemplary embodiment of the present invention. FIG. 5F shows a variation of single crystal particle 27*d*, and a shape having eight truncated faces and one rhombic face.

As discussed above, single crystal of magnesium oxide has an NaCl crystal structure having a cubic lattice, and has (100) faces, (110) faces, and (111) faces as main orientation faces. Of these orientation faces, (100) faces are the densest, and impure gas such as water, hydrocarbon, carbon dioxide gas hardly adsorbs to (100) faces in a wide temperature range from low temperature to high temperature. Therefore, when single crystal particles 27 mainly having (100) faces are used, particle layer 26*b* stably having high electron emission performance and high charge retention performance in a wide temperature range can be produced.

While, (111) faces have especially high electron emission performance at a normal temperature or higher, so that single crystal particles 27 mainly having (111) faces are important in achieving panel 10 capable of being driven at high speed.

A single crystal particle having an NaCl crystal structure that is surrounded by the specified two-type orientation face formed of (100) faces and (111) faces, and a single crystal particle having an NaCl crystal structure that is surrounded by the specified three-type orientation face formed of (100) faces, (110) faces, and (111) faces can be produced by a liquid phase method.

Specifically, as described below, these single crystal particles can be produced by uniformly firing magnesium hydroxide in a high-temperature oxygen-containing atmosphere. Here, the magnesium hydroxide is a precursor of magnesium oxide.

(Liquid Phase Method 1)

Aqueous solution of magnesium alkoxide or magnesium acetylacetone of a purity of 99.95% or higher is hydrolyzed by adding a small amount of acid to it, and gel of magnesium hydroxide is produced. Then, the gel is fired in the air to be dehydrated, thereby producing powder of single crystal particles 27.

(Liquid Phase Method 2)

Alkaline solution is added to aqueous solution of magnesium nitrate of a purity of 99.95% or higher to precipitate magnesium hydroxide. Then, the precipitate of magnesium hydroxide is separated from the aqueous solution, and is fired in the air to be dehydrated, thereby producing powder of single crystal particles 27.

(Liquid Phase Method 3)

Calcium hydroxide is added to aqueous solution of magnesium chloride of a purity of 99.95% or higher to precipitate magnesium hydroxide. Then, the precipitate of magnesium hydroxide is separated from the aqueous solution, and is fired in the air to be dehydrated, thereby producing powder of single crystal particles 27.

The firing temperature is preferably 700° C. or higher, more preferably 1000° C. or higher. This is because crystal faces do not sufficiently develop and hence defects increase at a temperature lower than 700° C. When the firing is performed at a temperature of 700° C. or higher and lower than 1500° C., the producing frequency of single crystal particles 27*c* and 27*d* surrounded by the specified three-type orientation face is high. When the firing is performed at a temperature of 1500° C. or higher, (110) faces are contracted and the producing frequency of single crystal particles 27*a* and 27*b* surrounded by the specified two-type orientation face is apt to become high. When the firing temperature is extremely high, oxygen deficiency occurs and defects of the magnesium oxide crystal increase, and hence the firing temperature is preferably set at 1800° C. or lower.

As the magnesium oxide precursor, in addition to the above-mentioned magnesium hydroxide, one or more of magnesium alkoxide, magnesium acetylacetone, magnesium nitrate, magnesium chloride, magnesium carbonate, magnesium sulfate, magnesium oxalate, and magnesium acetate can be used. The purity of the magnesium compound as the magnesium oxide precursor is preferably 99.95% or higher, more preferably 99.98% or higher. When many impurity elements such as alkali metal, boron, silicon, iron, and aluminum are contained, fusion or sintering between particles occurs during firing, and particles of high crystallinity hardly grow.

Single crystal particles 27 produced by the liquid phase methods are single crystal particles 27 that is surrounded by the specified two-type orientation face or specified three-type orientation face, and provide crystal having a small number of defects. Additionally, when the liquid phase methods are used, powder of relatively small variation in particle diameter of single crystal particles 27 can be obtained.

The crystal of magnesium oxide can be produced by a gas phase oxidation method, but magnesium oxide single crystal particles produced by the gas phase oxidation method have disadvantage that (100) faces mainly grow and the other faces hardly grow. This is considered to be for the following reason. When magnesium oxide is produced by the gas phase oxidation method, for example, a small amount of oxygen gas is made to flow while metal magnesium is heated to a high temperature in a tank filled with inert gas, and metal magnesium is directly oxidized to produce magnesium oxide crystal powder. Therefore, (100) faces, namely the densest faces, grow preferentially.

In the liquid phase method of the present embodiment, however, magnesium hydroxide as a precursor of magnesium oxide is hexagonal-system component and is different from the cubic-system structure of magnesium oxide. The crystal growth process of thermally decomposing magnesium hydroxide to produce magnesium oxide crystal is complicated, but magnesium oxide single crystal is produced while the form of the hexagonal system is kept, and hence (100) faces, (111) faces, and (110) faces are considered to be formed as the crystal faces.

Similarly, magnesium compounds such as magnesium alkoxide, magnesium nitrate, magnesium chloride, magnesium carbonate, magnesium sulfate, magnesium oxalate, and magnesium acetate are not cubic system. Therefore, when the magnesium compounds are thermally decomposed as the precursor of magnesium oxide to produce magnesium oxide crystal, not only (100) faces but also (111) faces and (110) faces are considered to be formed while an $(OR)_2$ group, a $Cl_2$ group, an $(NO_3)_2$ group, a $CO_3$ group, and a $C_2O_4$ group are desorbed.

The diameters of magnesium oxide single crystal particles produced by the gas phase oxidation method are apt to largely vary. Therefore, the manufacturing process of magnesium oxide using the gas phase oxidation method requires a classifying process of making the diameters constant.

However, using the liquid phase method of the present embodiment can provide relatively large single crystal particles of relatively constant diameters. For example, using the liquid phase method can provide crystal particles with a diameter of 0.3 to 2 μm. Therefore, the classifying process of removing micro particles can be omitted. Additionally, using the liquid phase method of the present embodiment can provide crystal of a large particle diameter. Therefore, the magnesium oxide crystal produced by the liquid phase method has a specific surface area smaller than that of the magnesium oxide crystal produced by the gas phase oxidation method, and has high adsorbing resistance.

Thus, particle layer 26*b* of the present embodiment is formed by sticking single crystal particles 27 or single crystal particles 27*d* to base protective layer 26*a*. Here, single crystal particles 27 have an NaCl crystal structure that is surrounded by the specified two-type orientation face formed of (100) faces and (111) faces, and single crystal particles 27*d* have an NaCl crystal structure that is surrounded by the specified three-type orientation face formed of (100) faces, (110) faces, and (111) faces. Panel 10 that has stably high electron emission performance and high charge retention performance in a wide temperature range and can be driven at high speed is achieved.

Next, a driving method of panel 10 of the embodiment of the present invention is described.

Figure 6:
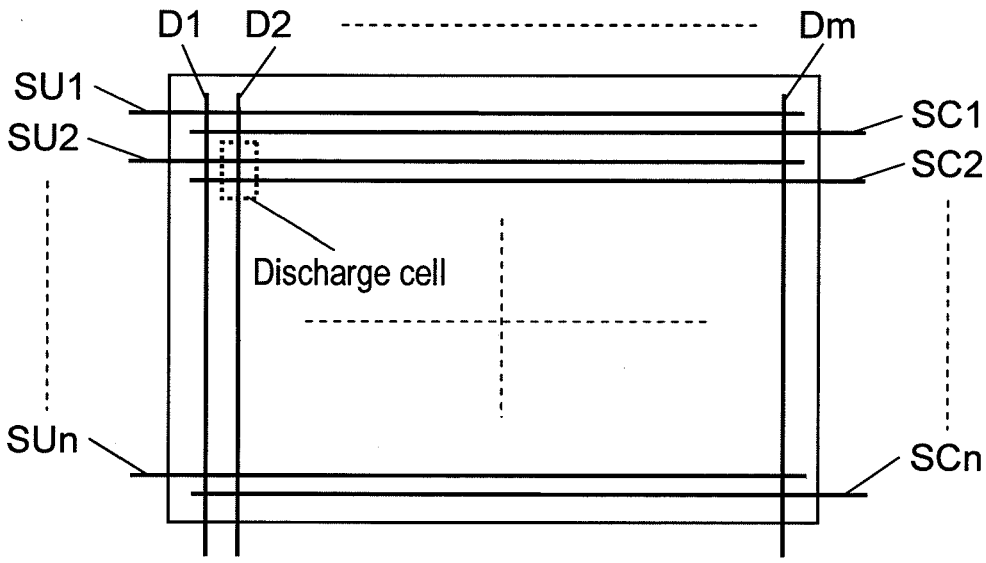
FIG. 6 is a diagram showing an electrode array of the panel.

FIG. 6 is a diagram showing an electrode array of panel 10 in accordance with the exemplary embodiment of the present invention. Panel 10 has n scan electrodes SC1 through SCn (scan electrodes 22 in FIG. 1) and n sustain electrodes SU1 through SUn (sustain electrodes 23 in FIG. 1) both long in the row direction (line direction), and m data electrodes D1 through Dm (data electrodes 32 in FIG. 1) long in the column direction. A discharge cell is formed in the part where a pair of scan electrode SCi (i is 1 through n) and sustain electrode SUi intersect with one data electrode Dj (j is 1 through m). Thus, m×n discharge cells are formed in the discharge space. When the panel is used in a high-definition plasma display device, the number of discharge cells is represented by m=1920×3=5760 and n=1080, for example.

Next, a driving voltage waveform to be applied to each electrode in order to drive panel 10 is described. Panel 10 performs the subfield method. In this method, one field period is divided into a plurality of subfields, and light emission and no light emission of each display cell are controlled in each subfield, thereby performing gradation display. Each subfield has an initializing period, an address period, and a sustain period.

In the initializing period, an initializing discharge is caused to produce, on each electrode, wall charge required for a subsequent address discharge. The initializing operation at this time has an initializing operation (hereinafter referred to as "all-cell initializing operation") for causing initializing discharge in all discharge cells and an initializing operation (hereinafter referred to as "selective initializing operation") for causing initializing discharge in a discharge cell that has undergone sustain discharge in the sustain period of the immediately preceding subfield.

In the address period, address discharge is selectively caused in a discharge cell to emit light, thereby producing wall charge. In the sustain period, as many sustain pulses as the number corresponding to luminance weight are alternately applied to the display electrode pairs, and sustain discharge is caused in the discharge cell having undergone an address discharge, thereby emitting light. The detail of the subfield structure is described later, and the driving voltage waveform and its operation in subfields are described hereinafter.

Figure 7:
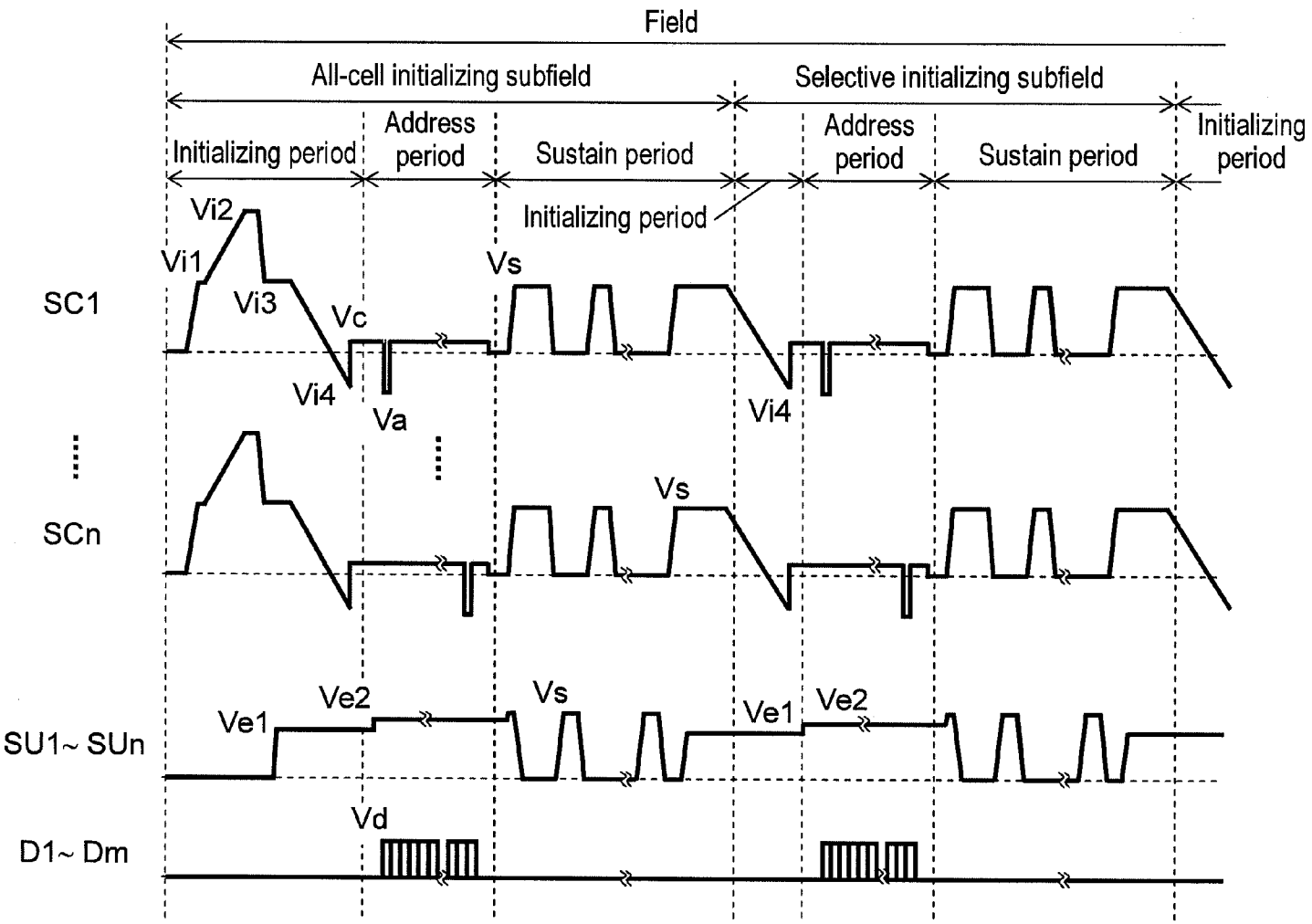
FIG. 7 is a waveform chart of driving voltage applied to each electrode of the panel.

FIG. 7 is a waveform chart of driving voltage applied to each electrode of panel 10 in accordance with the exemplary embodiment of the present invention. FIG. 7 shows a subfield where the all-cell initializing operation is performed and a subfield where the selective initializing operation is performed.

First, the subfield (all-cell initializing subfield) where the all-cell initializing operation is performed is described.

In the first half of the initializing period, 0 (V) is applied to data electrodes D1 through Dm and sustain electrodes SU1 through SUn, and ramp waveform voltage is applied to scan electrodes SC1 through SCn. Here, the ramp waveform voltage gradually increases from voltage Vi1, which is not higher than a discharge start voltage, to voltage Vi2, which is higher than the discharge start voltage, with respect to sustain electrodes SU1 through SUn.

While the ramp waveform voltage increases, a feeble initializing discharge occurs between scan electrodes SC1 through SCn and sustain electrodes SU1 through SUn, and a feeble initializing discharge occurs between scan electrodes SC1 through SCn and data electrodes D1 through Dm. Negative wall voltage is accumulated on scan electrodes SC1 through SCn, and positive wall voltage is accumulated on data electrodes D1 through Dm and sustain electrodes SU1 through SUn. Here, the wall voltage on the electrodes means the voltage generated by the wall charges accumulated on the dielectric layer covering the electrodes, on the protective layer, and on the phosphor layer. In the initializing discharge at this time, excessive wall voltage is accumulated in expectation of optimizing of the wall voltage in the subsequent latter half of the initializing period.

In the latter half of the initializing period, voltage Ve1 is applied to sustain electrodes SU1 through SUn, and ramp waveform voltage is applied to scan electrodes SC1 through SCn. Here, the ramp waveform voltage gradually decreases from voltage Vi3, which is not higher than the discharge start voltage, to voltage Vi4, which is higher than the discharge start voltage, with respect to sustain electrodes SU1 through SUn. While the ramp waveform voltage decreases, a feeble initializing discharge occurs between scan electrodes SC1 through SCn and sustain electrodes SU1 through SUn, and a feeble initializing discharge occurs between scan electrodes SC1 through SCn and data electrodes D1 through Dm. The negative wall voltage on scan electrodes SC1 through SCn and the positive wall voltage on sustain electrodes SU1 through SUn are reduced, and positive wall voltage on data electrodes D1 through Dm is adjusted to a value suitable for the address operation. Thus, the all-cell initializing operation of applying initializing discharge to all discharge cells is completed.

In the subsequent address period, voltage Ve2 is applied to sustain electrodes SU1 through SUn, and voltage Vc is applied to scan electrodes SC1 through SCn.

Next, negative scan pulse voltage Va is applied to scan electrode SC1 in the first line, and positive address pulse voltage Vd is applied to data electrode Dk (k is 1 through m) in the discharge cell to emit light in the first line, among data electrodes D1 through Dm. At this time, the voltage difference in the intersecting part of data electrode Dk and scan electrode SC1 is derived by adding the difference between the wall voltage on data electrode Dk and that on scan electrode SC1 to the difference (Vd−Va) between the external applied voltages, and exceeds the discharge start voltage. An address discharge thus occurs between data electrode Dk and scan electrode SC1 and between sustain electrode SU1 and scan electrode SC1, positive wall voltage is accumulated on scan electrode SC1, negative wall voltage is accumulated on sustain electrode SU1, and negative wall voltage is also accumulated on data electrode Dk.

The time since the application of scan pulse voltage Va and address pulse voltage Vd until the occurrence of address discharge is referred to as "discharge delay time". If the electron emission performance of the panel is low and the discharge delay time is long, the time period when scan pulse voltage Va and address pulse voltage Vd are applied in order to certainly perform the address operation, namely scan pulse width and address pulse width, is required to be set long, and high-speed address operation cannot be performed. If the charge retention performance of the panel is low, the values of scan pulse voltage Va and address pulse voltage Vd are required to be set high in order to compensate for the reduction in wall voltage. However, panel 10 of the present embodiment has high electron emission performance, so that the scan pulse width and address pulse width can be set shorter than those of the conventional panel and a high-speed address operation can be stably performed. Panel 10 of the present embodiment has high charge retention performance, so that the values of scan pulse voltage Va and address pulse voltage Vd can be set lower than those of the conventional panel.

Thus, an address operation of causing an address discharge in the discharge cell to emit light in the first line and accumulating wall voltage on each electrode is performed. The voltage in the part where scan electrode SC1 intersects with data electrodes D1 through Dm having been applied with no address pulse voltage Vd does not exceed the discharge start voltage, so that address discharge does not occur. This address operation is repeated until it reaches the discharge cell in the n-th line, and the address period is completed.

In the subsequent sustain period, positive sustain pulse voltage Vs is firstly applied to scan electrodes SC1 through SCn, and 0 (V) is applied to sustain electrodes SU1 through SUn. In the discharge cell having undergone the address discharge, the voltage difference between scan electrode SCi and sustain electrode SUi is obtained by adding the difference between the wall voltage on scan electrode SCi and that on sustain electrode SUi to sustain pulse voltage Vs, and exceeds the discharge start voltage.

Sustain discharge occurs between scan electrode SCi and sustain electrode SUi, and ultraviolet rays generated at this time cause phosphor layer 35 to emit light. Negative wall voltage is accumulated on scan electrode SCi, and positive wall voltage is accumulated on sustain electrode SUi. Positive wall voltage is also accumulated on data electrode Dk. In the discharge cell having undergone no address discharge in the address period, sustain discharge does not occur and the wall voltage at the end of the initializing period is kept.

Subsequently, 0 (V) is applied to scan electrodes SC1 through SCn, and sustain pulse voltage Vs is applied to sustain electrodes SU1 through SUn. In the discharge cell having undergone the sustain discharge, the voltage difference between sustain electrode SUi and scan electrode SCi exceeds the discharge start voltage. Therefore, a sustain discharge occurs between sustain electrode SUi and scan electrode SCi again, negative wall voltage is accumulated on sustain electrode SUi, and positive wall voltage is accumulated on scan electrode SCi. Hereinafter, similarly, as many sustain pulses as the number corresponding to the luminance weight are alternately applied to scan electrodes SC1 through SCn and sustain electrodes SU1 through SUn to apply potential difference between the electrodes of the display electrode pairs. Thus, a sustain discharge is successively performed in the discharge cell where the address discharge has been caused in the address period.

At the end of the sustain period, the so-called narrow-width pulse-like potential difference or ramp-waveform potential difference is applied between scan electrodes SC1 through SCn and sustain electrodes SU1 through SUn, and wall voltage on scan electrode SCi and sustain electrode SUi is erased while positive wall voltage is left on data electrode Dk.

Next, the subfield (selective initializing subfield) where the selective initializing operation is performed is described.

In the initializing period when the selective initializing operation is performed, voltage Ve1 is applied to sustain electrodes SU1 through SUn, 0 (V) is applied to data electrodes D1 through Dm, and ramp voltage gradually decreasing to voltage Vi4 is applied to scan electrodes SC1 through SCn. In the discharge cell that has undergone the sustain discharge in the sustain period of the preceding subfield, a feeble initializing discharge occurs, and the wall voltages on scan electrode SCi and sustain electrode SUi are reduced. Regarding data electrode Dk, sufficient positive wall voltage is accumulated on data electrode Dk by the immediately preceding sustain discharge, so that the excessive part of the wall voltage is discharged to adjust the wall voltage to be appropriate for the address operation.

While, in the discharge cell having undergone no sustain discharge in the preceding subfield, no discharge occurs and the wall charge at the end of the initializing period of the preceding subfield is kept without variation. The selective initializing operation is thus an operation of selectively performing the initializing discharge in the discharge cell where a sustain operation has been performed in the sustain period in the immediately preceding subfield.

The operation in the subsequent address period is the same as that in the address period of the subfield where the all-cell initializing operation is performed, so that the description is omitted. The operation in the subsequent sustain period is performed in the same manner except for the number of sustain pulses.

The subfield structure of the driving method of the present embodiment is described. In the driving method of the present embodiment, subfields are temporally disposed so that the luminance weight monotonically decreases from an all-cell initializing subfield to the subfield immediately before the next all-cell initializing subfield. In other words, the luminance weight of the selective initializing subfield following the all-cell initializing subfield is set smaller than or equal to the luminance weight in the immediately preceding subfield. The luminance weight of the selective initializing subfield following the selective initializing subfield is set smaller than or equal to the luminance weight in the immediately preceding subfield. Thus, the subfield structure set so that the luminance weight monotonically decreases from the all-cell initializing subfield to the subfield immediately before the next all-cell initializing subfield is referred to as "descending coding".

Figure 8:
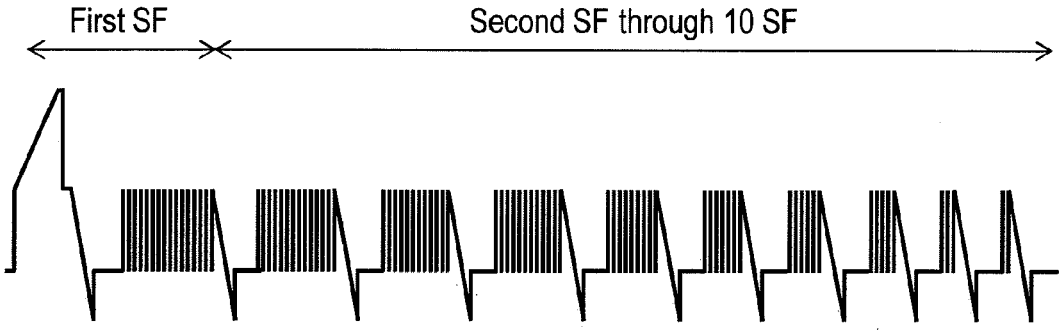
FIG. 8 is a diagram showing a subfield structure in accordance with the exemplary embodiment of the present invention.

FIG. 8 is a diagram showing the subfield structure in accordance with the exemplary embodiment of the present invention. In the present embodiment, one field is divided into 10 subfields (first SF, second SF, . . . , 10th SF), and respective subfields have luminance weights of 80, 60, 44, 30, 18, 11, 6, 3, 2, and 1. The first SF is an all-cell initializing subfield, and the second SF through 10th SF are selective initializing subfields. FIG. 8 schematically shows one field of the driving voltage waveform to be applied to scan electrode 22. The detail of the driving voltage waveform in each period of each subfield is shown in FIG. 7.

In the present embodiment, panel 10 is driven with descending coding. The driving with the descending coding can achieve a plasma display device that has high image display quality and can perform a higher-speed and stable address operation while exhibiting the performance of panel 10 drivable at high speed. Additionally, the driving with descending coding can further reduce the address pulse voltage and can decrease the power consumption of the plasma display device.

The reason for this is described hereinafter. The inventors measure the discharge delay time of panel 10 of the present embodiment. The measured panel is the panel (of the present invention) having protective layer 26 having particle layer 26*b*. Particle layer 26*b* is formed by sticking two types of single crystal particles to base protective layer 26*a* so that the particles are distributed substantially uniformly on the whole surface of base protective layer 26*a*. Here, the two types of single crystal particles are the followings:

- single crystal particles having an NaCl crystal structure that is surrounded by the specified two-type orientation face formed of (100) faces and (111) faces; and
- single crystal particles having an NaCl crystal structure that is surrounded by the specified three-type orientation face formed of (100) faces, (110) faces, and (111) faces.

This panel is a 42-inch panel of high luminance and high definition where discharge gas is 100% xenon gas. For comparison, the discharge delay time of the conventional panel having only base protective layer 26*a* (having no particle layer 26*b*) is measured.

The discharge delay time of the address discharge is measured in a discharge cell controlled so that address discharge is not caused in its adjacent discharge cell, in order to prevent the measurement from being affected by a discharge from its surrounding discharge cells. The discharge delay time is affected by a phosphor material, but the discharge delay time is measured in the discharge cell coated with green phosphor that is apt to increase the discharge delay time.

In order to obtain the relation between the discharge delay time and the elapsed time since the all-cell initializing operation, the discharge delay time obtained when the address operation is performed only in each of the first SF through the 10th SF is measured. The number of sustain pulses at this time is set at two regardless of the subfield. In order to obtain the relation between the discharge delay time and the number of sustain pulses, the address operation is performed only in the fifth SF, and the number of sustain pulses in the subsequent sustain period is varied from 2 to 256, and the discharge delay time is measured.

Figure 9A:
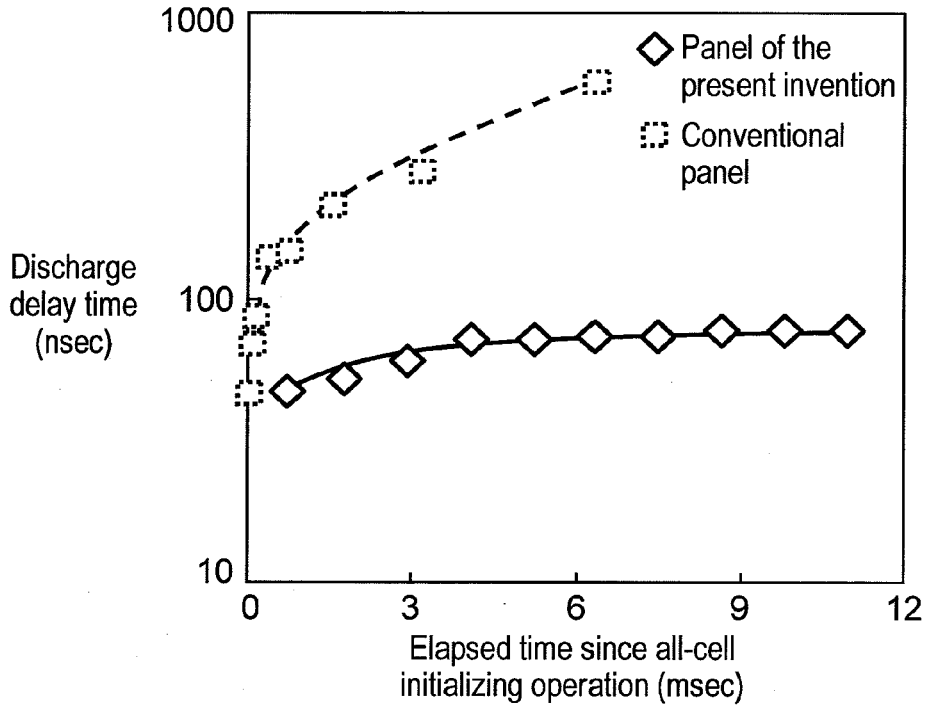
FIG. 9A is a diagram showing the relation between the discharge delay time and the elapsed time since an all-cell initializing operation in the panel in accordance with the exemplary embodiment of the present invention.
Figure 9B:
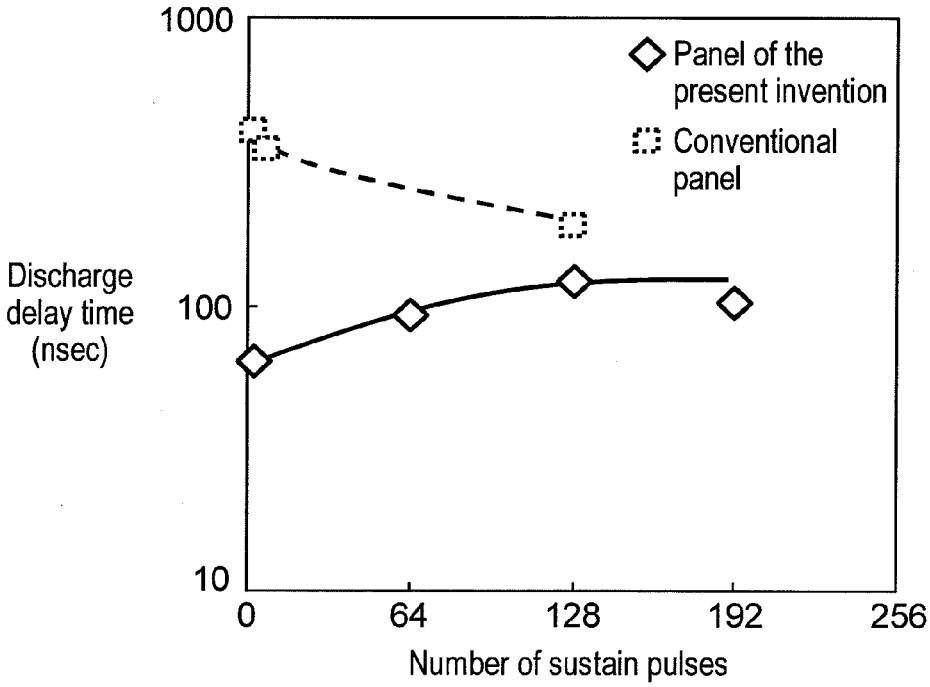
FIG. 9B is a diagram showing the relation between the discharge delay time and the number of sustain pulses in the panel.

FIG. 9A is a diagram showing the relation between the discharge delay time and the elapsed time since the all-cell initializing operation in panel 10 in accordance with the exemplary embodiment of the present invention. FIG. 9B is a diagram showing the relation between the discharge delay time and the number of sustain pulses in panel 10 in accordance with the exemplary embodiment of the present invention. For comparison, FIG. 9A and FIG. 9B show the characteristics of the conventional panel with a broken line.

Thus, the discharge delay time of panel 10 of the present embodiment is extremely shorter than that of the conventional panel. This is because panel 10 of the present embodiment has high electron emission performance and hence the discharge delay time is short. According to FIG. 9A, panel 10 of the present embodiment has a tendency that the discharge delay time becomes long with the elapsed time since the all-cell initializing operation. This tendency is similar to that of the conventional panel. This is considered to be because the priming occurring in the all-cell initializing operation decreases with time and the discharge hardly occurs.

While, attention is focused on the relation between the discharge delay time and the number of sustain pulses. As shown in FIG. 9B, the discharge delay time becomes short as the number of sustain pulses increases in the conventional panel, but the discharge delay time is apt to become long as the number of sustain pulses increases in panel 10 of the present embodiment. Generally, it is considered that, when the number of sustain pulses increases, the priming following the sustain discharge increases and hence the discharge delay time becomes short. However, panel 10 of the present embodiment has the opposite tendency. The reason why such a tendency of panel 10 of the present embodiment occurs is not perfectly clarified, but one considerable reason is as follows. Of a formative delay time and a statistical delay time for determining the discharge delay time, the statistical delay time being significantly affected by the priming is sufficiently short, so that priming following the sustain discharge does not largely contribute to the discharge delay time. However, panel 10 of the present embodiment has charge retention performance higher than that of the conventional panel, but the wall charge reduces slightly. Therefore, the wall charge reduces in response to the sustain discharge, the voltage substantially applied between the electrodes decreases, the discharge formative delay time increases, and hence the discharge delay time increases.

In the panel of low electron emission performance, the influence of the priming on the statistical delay time can cover a large range, namely 100 to 1000 ns, but the influence of the reduction in wall voltage on the formative delay time covers a relatively small range, namely about 100 ns. Therefore, in the panel of low electron emission performance, the influence of the priming on the statistical delay time is stronger, and the discharge delay time decreases with increase of the number of sustain pulses. In panel 10 of the present embodiment having high electron emission performance, however, the influence of the priming on the discharge delay is small, the influence of the reduction in wall voltage on the statistical delay time is strong even when the charge retention performance is high, and the discharge delay time increases with increase of the number of sustain pulses.

Thus, panel 10 of the present embodiment has tendencies that increase of the number of sustain pulses increases the discharge delay time, and increase of the elapsed time since the all-cell initializing operation increases the discharge delay time. Therefore, by employing the subfield structure of descending coding, the condition of elongating the discharge delay time and the condition of shortening it cancel each other, and high-speed driving exploiting the feature of panel 10 of the present embodiment is allowed. Here, in this subfield structure, the number of sustain pulses is large when the elapsed time since the all-cell initializing operation is short, and the number of sustain pulses is small when the elapsed time since the all-cell initializing operation is long.

Figure 10:
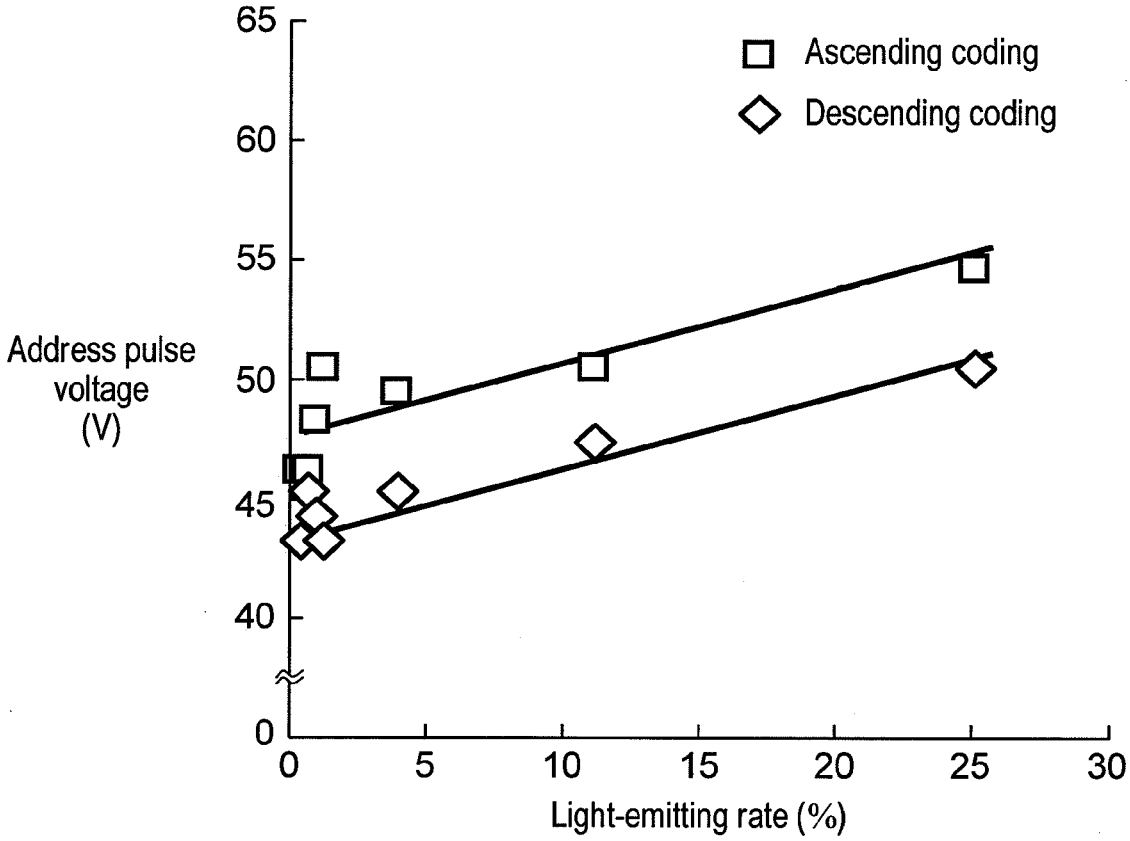
FIG. 10 is a diagram showing the lowest of voltages applied to a data electrode when the panel has a subfield structure of descending coding and when the panel has a subfield structure of ascending coding.

This subfield structure of the descending coding can reduce the voltage applied to data electrodes D1 through Dm. FIG. 10 is a diagram showing the lowest of voltages applied to data electrodes D1 through Dm in the following two cases:

- panel 10 of the present embodiment is driven with a subfield structure of descending coding where subfields are disposed so that the luminance weight monotonically decreases; and
- panel 10 is driven with a subfield structure of ascending coding where subfields are disposed so that the luminance weight monotonically increases.

According to FIG. 10, the required address pulse voltage increases in response to increase in light-emitting rate, but the subfield structure of descending coding can decrease address pulse voltage Vd by about 5 (V). Thus, the electric power of the data electrode driving circuit can be reduced.

One example of the panel driving circuits for driving panel 10 by generating the driving voltage is hereinafter described.

Figure 11:
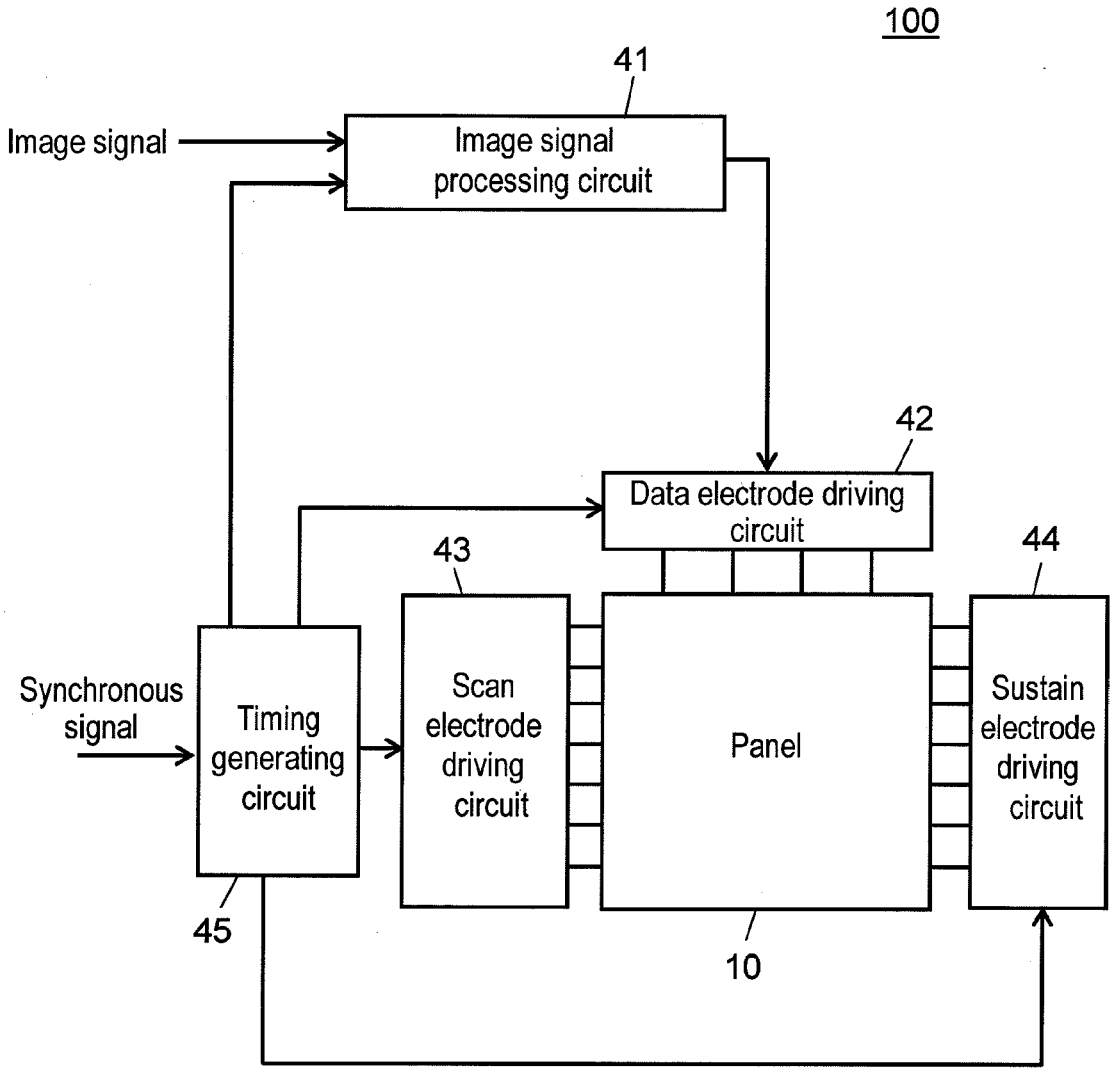
FIG. 11 is a circuit block diagram of a plasma display device in accordance with the exemplary embodiment of the present invention.

FIG. 11 is a circuit block diagram of plasma display device 100 in accordance with the exemplary embodiment of the present invention. Plasma display device 100 has panel 10 and a panel driving circuit. Protective layer 26 of panel 10 has base protective layer 26*a* formed of a thin film containing magnesium oxide, and has particle layer 26*b*. Particle layer 26*b* is formed by sticking, to base protective layer 26*a*, single crystal particles 27 of magnesium oxide having an NaCl crystal structure that is surrounded by the specified two-type orientation face formed of (100) faces and (111) faces, or single crystal particles 27 of magnesium oxide having an NaCl crystal structure that is surrounded by the specified three-type orientation face formed of (100) faces, (110) faces, and (111) faces. The panel driving circuit drives panel 10 by the following processes:

- performing one of the all-cell initializing operation of causing initializing discharge in all discharge cells and the selective initializing operation of causing initializing discharge in a discharge cell that has undergone sustain discharge before it
- temporally disposing the subfields so that the luminance weight monotonically decreases from a subfield in which the all-cell initializing operation is performed to the subfield immediately before the subfield in which the next all-cell initializing operation is performed; and driving panel 10.

The panel driving circuit has the following elements:

image signal processing circuit 41;

data electrode driving circuit 42;

scan electrode driving circuit 43;

sustain electrode driving circuit 44;

timing generating circuit 45; and a power supply circuit (not shown) for supplying power required for each circuit block.

Image signal processing circuit 41 converts an input image signal into image data that indicates emission or non-emission of light in each subfield.

Data electrode driving circuit 42 converts the image data in each subfield into a signal corresponding to each of data electrodes D1 through Dm, and drives each of data electrodes D1 through Dm. Timing generating circuit 45 generates various timing signals for controlling operations of respective circuit blocks based on a horizontal synchronizing signal and a vertical synchronizing signal, and supplies them to respective circuit blocks. Scan electrode driving circuit 43 drives each of scan electrodes SC1 through SCn based on a timing signal, and sustain electrode driving circuit 44 drives sustain electrodes SU1 through SUn based on a timing signal.

Figure 12:
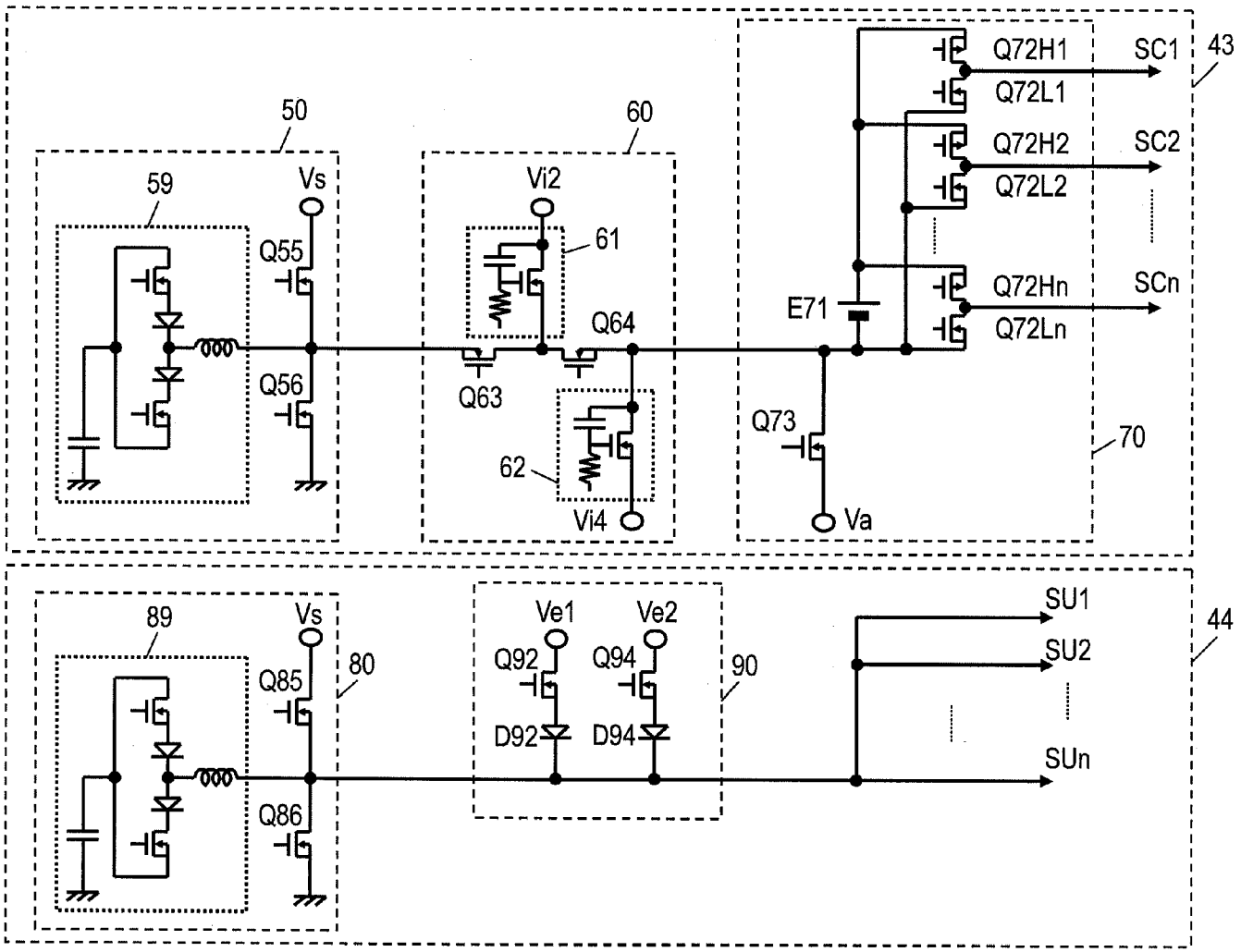
FIG. 12 is a circuit diagram of a scan electrode driving circuit and a sustain electrode driving circuit of the plasma display device.

FIG. 12 is a circuit diagram of scan electrode driving circuit 43 and sustain electrode driving circuit 44 of plasma display device 100 in accordance with the exemplary embodiment of the present invention.

Scan electrode driving circuit 43 has sustain pulse generating circuit 50, initializing waveform generating circuit 60, and scan pulse generating circuit 70. Sustain pulse generating circuit 50 has the following elements:

switching element Q55 for applying voltage Vs to scan electrodes SC1 through SCn;

switching element Q56 for applying 0 (V) to scan electrodes SC1 through SCn;

electric power recovering section 59 for recovering electric power when a sustain pulse is applied to scan electrodes SC1 through SCn.

Initializing waveform generating circuit 60 has Miller integrating circuit 61 for applying up-ramp waveform voltage to scan electrodes SC1 through SCn, and Miller integrating circuit 62 for applying down-ramp waveform voltage to scan electrodes SC1 through SCn. Switching element Q63 and switching element Q64 prevent current from flowing backward through a parasitic diode or the like of another switching element. Scan pulse generating circuit 70 has the following elements:

floating power supply E71;

switching elements Q72H1 through Q72Hn and Q72L1 through Q72Ln for applying voltage on the high voltage side of floating power supply E71 or voltage on the low voltage side thereof to respective scan electrodes SC1 through SCn; and switching element Q73 for fixing the voltage on the low voltage side of floating power supply E71 to voltage Va.

Sustain electrode driving circuit 44 has sustain pulse generating circuit 80, and initializing/address voltage generating circuit 90. Sustain pulse generating circuit 80 has the following elements:

switching element Q85 for applying voltage Vs to sustain electrodes SU1 through SUn;

switching element Q86 for applying 0 (V) to sustain electrodes SU1 through SUn; and electric power recovering section 89 for recovering electric power when a sustain pulse is applied to sustain electrodes SU1 through SUn.

Initializing/address voltage generating circuit 90 has the following elements:

switching element Q92 and diode D92 for applying voltage Ve1 to sustain electrodes SU1 through SUn; and switching element Q94 and diode D94 for applying voltage Ve2 to sustain electrodes SU1 through SUn.

These switching elements can be formed of generally known elements such as a metal oxide semiconductor field effect transistor (MOSFET) and an insulated gate bipolar transistor (IGBT). Each of these switching elements is controlled by a timing signal corresponding to the switching element generated by timing generating circuit 45.

The driving circuit shown in FIG. 12 is an example of circuitry for generating the driving voltage waveform of FIG. 7. The plasma display device of the present invention is not limited to this circuitry.

Figure 13:
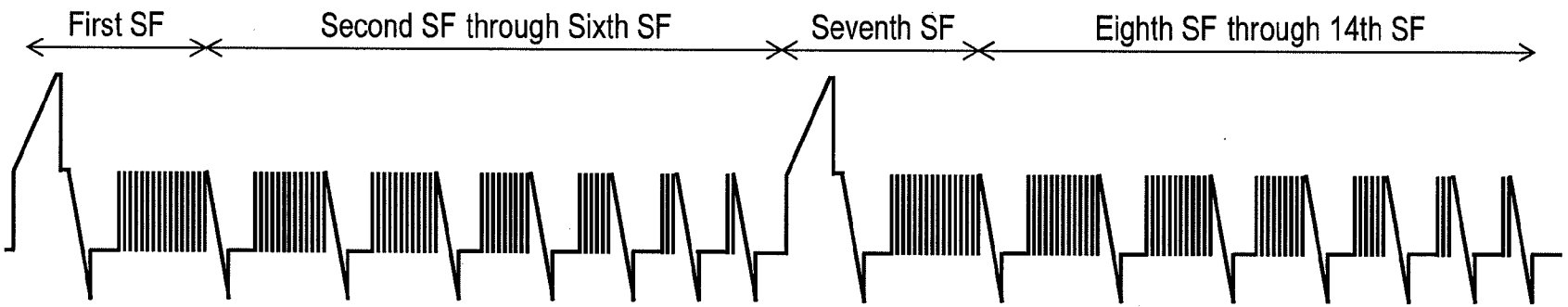
FIG. 13 is a diagram showing a subfield structure in accordance with another exemplary embodiment of the present invention.

In the present embodiment, one field is divided into 10 subfields, and only the first SF is an all-cell initializing subfield. The present invention is not limited to this. FIG. 13 is a diagram showing a subfield structure in accordance with another exemplary embodiment of the present invention. In FIG. 13, the following conditions are set:

the number of subfields is "14";

the first SF and the seventh SF are all-cell initializing subfields;

the luminance weight monotonically decreases from the first SF to the sixth SF; and the luminance weight monotonically decreases also from the seventh SF to the 14th SF.

Thus, it is important to be set that the luminance weight monotonically decreases from an all-cell initializing subfield to the subfield immediately before the next all-cell initializing subfield. The number of subfields may be set arbitrarily as required, and the subfields for all-cell initializing operation and the number of subfields may be set arbitrarily.

Each of the specific numerical values used in the present embodiment is simply one example. Preferably, optimal values are set appropriately in response to the characteristic of the panel and the specification of the plasma display device.

INDUSTRIAL APPLICABILITY

The plasma display device of the present invention performs a high-speed and stable address operation and can display an image of high display quality. Therefore, this plasma display device can be used as a display device.

The invention claimed is:

1. A plasma display device comprising:

a plasma display panel including (i) a front plate having display electrode pairs on a first glass substrate, a dielectric layer for covering the display electrode pairs, and a protective layer on the dielectric layer, the display electrode pairs including a scan electrode and a sustain electrode, (ii) a back plate having data electrodes on a second glass substrate, the back plate being positioned to face the front plate, and (iii) discharge cells formed at positions where the display electrode pairs face the data electrodes; and a panel driving circuit for driving the plasma display panel while a plurality of subfields are temporally disposed to form one field period, each of the plurality of subfields having an initializing period for causing an initializing discharge, an address period for causing an address discharge, and a sustain period for causing a sustain discharge in the discharge cells, wherein the protective layer has:

a base protective layer formed of a thin film of metal oxide containing at least one of magnesium oxide, strontium oxide, calcium oxide, and barium oxide; and a particle layer formed by sticking single crystal particles of magnesium oxide having an NaCl crystal structure to the base protective layer, the single-crystal particles of magnesium oxide, which have the NaCl crystal structure, having faces consisting of either (a) (100) and (111) crystal planes or (b) (100), (110), and (111) crystal planes, and wherein the panel driving circuit performs, in the initializing period, one of (i) an all-cell initializing operation of causing an initializing discharge in all discharge cells and (ii) a selective initializing operation of causing an initializing discharge in a discharge cell that has undergone a sustain discharge before the initializing period, temporally disposes the subfields so that the luminance weight monotonically decreases from (i) a subfield in which the all-cell initializing operation is performed to (ii) a subfield immediately before the subfield in which a next all-cell initializing operation is performed, and drives the plasma display panel, wherein while the panel driving circuit performs the all-cell initializing operation, a gradually increasing ramp waveform voltage is applied to the scan electrode, and then a gradually decreasing ramp waveform voltage is applied to the scan electrode, wherein while the panel driving circuit performs the selective initializing operation, a gradually decreasing ramp waveform voltage is applied to the scan electrode, wherein the plasma display panel has a property, as measured when an address operation is carried out only in the fifth sub-field and the number of sustain pulses in the subsequent sustain period is varied from 2 to 256, that a discharge delay time related to a sub-field increases as the number of sustain pulses in the sub-field increases, and wherein a discharge delay time of an address discharge related to a sub-field increases as an elapsed time since an all-cell initializing operation is performed in the sub-filed increases.

2. The plasma display device of claim 1, wherein the particle layer is a fired product of a magnesium oxide precursor.

* * * * *